US005273453A

United States Patent [19]

Manassero et al.

[11] Patent Number: 5,273,453

[45] Date of Patent: Dec. 28, 1993

[54] ELECTRICAL CONNECTOR WITH POSITIVE LATCH

[75] Inventors: Lorenzo Manassero, Turin, Italy; Uwe Schwarz, Ludwigsau/Hess, Fed. Rep. of Germany

[73] Assignee: Molex Incorporated, Lisle, Ill.

[21] Appl. No.: 896,080

[22] Filed: Jun. 8, 1992

[51] Int. Cl.[5] ..... H01R 13/627

[52] U.S. Cl. ..... 439/352; 439/354

[58] Field of Search ..... 439/345, 350, 352, 353, 439/354, 357, 358

[56] References Cited

U.S. PATENT DOCUMENTS

| | | | |
|---|---|---|---|
| 3,933,406 | 1/1976 | Cameron et al. . | |
| 4,026,624 | 5/1977 | Boag . | |
| 4,273,403 | 6/1981 | Cairns . | |
| 4,900,263 | 2/1990 | Manassero et al. | 439/358 |
| 4,940,430 | 7/1990 | Fujitani et al. | 439/352 X |

*Primary Examiner*—Larry I. Schwartz

*Assistant Examiner*—Khiem Nguyen

*Attorney, Agent, or Firm*—A. A. Tirva

[57] ABSTRACT

An electrical connector assembly is provided for achieving positive latching in a fully mated condition. The assembly includes a first connector and a second connector. The first connector has at least one latch arm resiliently deflectable about two angularly aligned axes of deflection. The second connector includes a cam disposed for engagement with the latch arm during mating of the connectors and for deflecting the latch arm about a first of the two axes of deflection into a latching condition in response to full mating of the connectors. The second connector includes a housing for enclosing the latch arm inside the housing when the connectors are fully mated. Access is provided to the latch arm of the first connector from outside the housing of the second connector whereby the latch arm can be deflected about a second of the two axes of deflection to enable disengagement of the latch arm from the cam for facilitating unmating of the connector.

6 Claims, 3 Drawing Sheets

ELECTRICAL CONNECTOR WITH POSITIVE LATCH

FIELD OF THE INVENTION

This invention generally relates to the art of electrical connectors and, particularly, to an electrical connector assembly for achieving positive latching in a fully mated condition of the assembly.

BACKGROUND OF THE INVENTION

Electrical connectors comprise nonconductive housings in which one or more electrically conductive terminals are mounted. The terminals are mechanically and electrically joined to conductive leads, such as wires, cables or conductive areas on a circuit board. Electrical connectors are employed in mateable pairs, wherein the respective housings and terminals in a pair are mateable with one another. Thus, for example, a pair of electrical connectors may enable electrical connections between the conductors of a cable and the printed circuits on a board.

The mateable terminals in a pair of electrical connectors are specifically designed to achieve substantial contact forces against one another in their fully mated condition. These necessary contact forces can result in significant insertion forces during mating, particularly as the number of terminals in a connector increases.

The existence of high insertion forces creates the possibility that the person who mates two electrical connectors will stop short of complete insertion. Incomplete insertion of mated connectors typically will yield less than specified contact forces between the mated terminals and can result in poor electrical performance or unintended separation of the partly mated connectors, particularly in a high vibration environment such as an automobile.

To help ensure complete insertion and to prevent unintended separation of mated connectors, many electrical connector housings are provided with interengageable locks. In particular, one connector may comprise a deflectable latch, while the opposed mateable connector may comprise a locking structure for engagement by the latch. Most connectors with deflectable latches and corresponding lock structures can lockingly retain connectors in their mated condition, but require complex manipulation to achieve mating or unmating. The above described high insertion forces in combination with the manipulation required for the locking means can make mating and unmating particularly difficult.

The prior art includes ramped locking structures which are intended to assist in the complete insertion of the connectors. In particular, the prior art includes connectors where a deflectable latch on one connector and a corresponding locking structure on the mateable connector are constructed such that the resiliency of the latches and the angular alignment of the ramps cooperate to urge the connectors toward a fully mated condition. Examples of connectors with this general construction are shown in U.S. Pat. No. 4,026,624 which issued to Boag on May 31, 1977 and U.S. Pat. No. 4,273,403 which issued to Cairns on Jun. 15, 1981. In these and other similar connectors, the unmating of connectors is rendered difficult by the need to overcome both the contact forces in the terminals and the ramping forces in the latches of the housing. Thus, although these connectors may facilitate the mating of connectors, they require substantially greater forces for unmating.

The manipulation of these connectors is rendered even more difficult by the complex plural deflections that are required within the latch structures both during mating and during unmating. In particular, connectors of this type have required latch structures that gradually deflect about plural axes during mating and unmating, such as a deflection toward or away from the adjacent plane of the connector housing and a deflection parallel to the plane. The excessive forces required for such mating or unmating may be sufficient to damage adjacent parts of the connector, such as the fragile electrical connections between terminals and leads therein.

Improvements over the prior art are disclosed in U.S. Pat. No. 4,900,263 to Manassero et al., dated Feb. 13, 1990 and assigned to the assignee of this invention. That patent provides a positive latch structure for electrical connectors to assist in the final mating thereof and to ensure positively latched engagement in a fully mated condition. Unmating is achieved without the need to overcome ramping forces of deflectable latch components. Generally, deflectable latches undergo only simple deflection about a single axis during mating and a simple deflection about a different axis during unmating, while still achieving positive locking in the fully mated condition. The latches generally are in the form of integrally molded latch arms and are shown in various embodiments. The latch arms are exposed on the outside of the connector housings for ready disengagement. For instance, one embodiment shows latch arms which may be deflected by the use of a disengagement tool such as a screw driver. In another embodiment, the latch arms are joined to the remainder of the associated housing at a fulcrum or root. The latch arms may extend to opposite sides of the root such that portions of the latch arms on one side of the root perform a locking function, while portions of the latch arms on the opposite side of the root may be conveniently activated to permit deflection of the latch arms for disengaging the arms from the opposed connector.

In some instances, it is desirable to have the positive latch means of a connector assembly concealed within a connector housing or housings. In such instances, access to the latch means must somehow be provided, in contrast to the readily accessible latch arms of the embodiments in the 4,900,263 patent. Although the '263 patent discloses valuable improvements over the prior art, the present invention is directed to providing further improvements wherein the latch means can be concealed within the connector assembly and still be made accessible for deflection to disengage the latch means.

SUMMARY OF THE INVENTION

An object, therefore, of the invention is to provide a new and improved electrical connector assembly of the character described for achieving positive latching of a pair of connectors in a fully mated condition, while affording an improved disengaging means for the connectors.

Generally, the invention contemplates providing an electrical connector assembly which includes first and second mateable connectors. The first connector includes at least one latch arm resiliently deflectable about two angularly aligned axes of deflection. A second connector includes a cam disposed for engagement with the latch arm during mating of the connectors and for deflecting the latch arm about a first of the two axes of deflection into a latching condition in response to full mating of the connectors. The second connector includes a housing covering and concealing the latch arm inside the housing when the connectors are fully mated. The invention contemplates means for accessing the latch arm of the first connector from outside the housing of the second connector and to deflect the latch arm about a second of the two axes of deflection to enable disengagement of the latch arm from the cam for facilitating unmating of the connectors.

In one embodiment of the invention, the means for accessing the latch arm and deflecting the latch arm about the second axis are provided in the form of deflecting means on the housing of the second connector. Preferably, the connector housings are molded of plastic material. In the one embodiment of the invention, the deflecting means is in the form of a lever unitarily molded with the housing. The lever is cantilevered and movable into engagement with the latch arm to move the latch arm out of engagement with the cam.

In another embodiment of the invention, the means for accessing the latch arm and deflecting the latch arm about the second axis are provided in the form of a deflecting tool insertable through an access opening in the housing into engagement with the latch arm to move the latch arm out of engagement with the cam. As disclosed herein, the housing of the second connector has a mating end for receiving the first connector and a terminating end. The access opening is located in the mating end of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION

Figure 1:
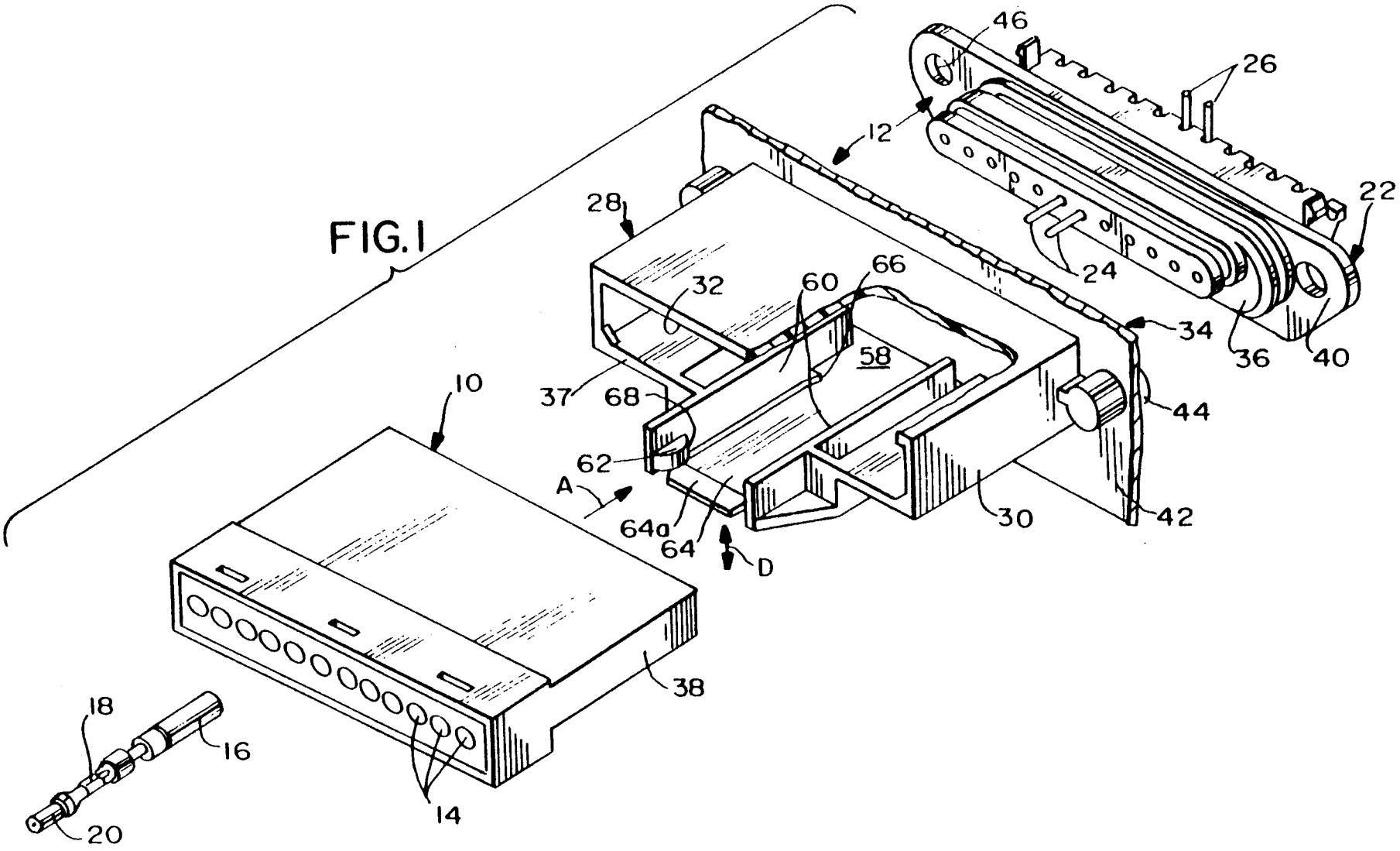
FIG. 1 an exploded perspective view of one embodiment of the components of an electrical connector assembly embodying the concepts of the invention.
Figure 2:
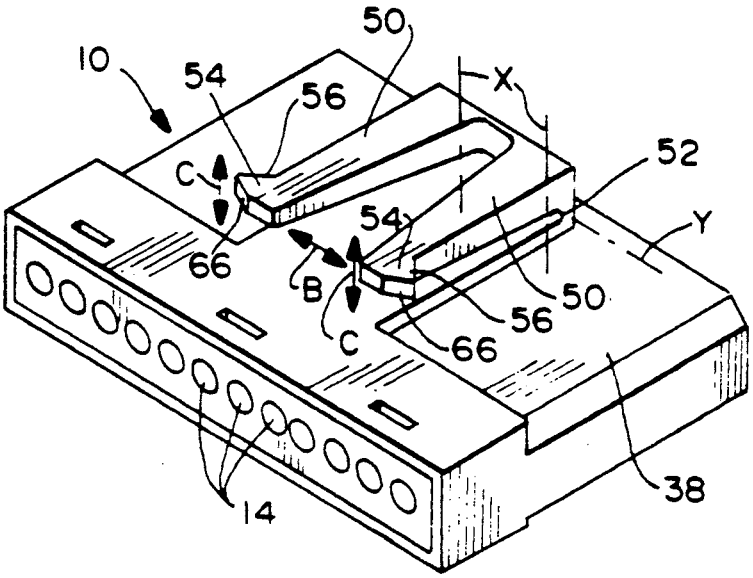
FIG. 2 is a perspective view of the first or receptacle connector, inverted relative to the position of the connector shown in FIG. 1, to illustrate the latch arms on the bottom thereof.
Figure 4:
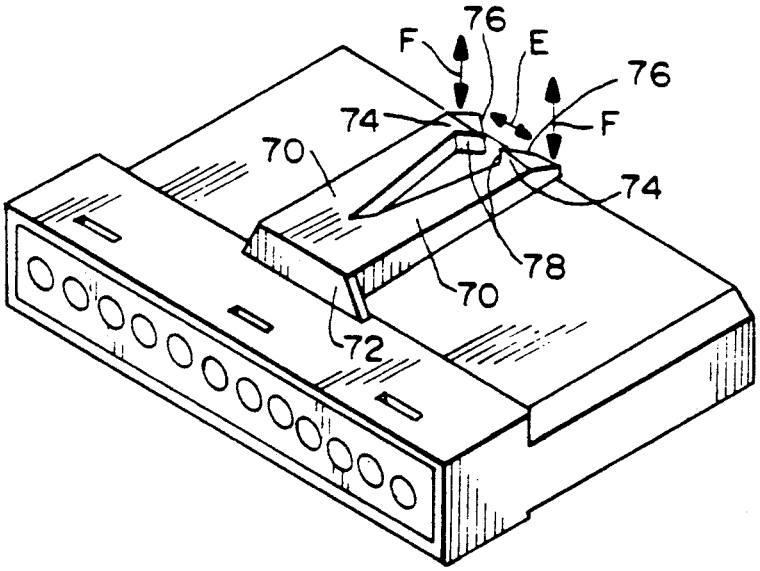
FIG. 4 is a perspective view of the first or receptacle connector, inverted relative to the position of the connector shown in FIG. 3, to illustrate the latch arms on the bottom thereof.
Figure 5:
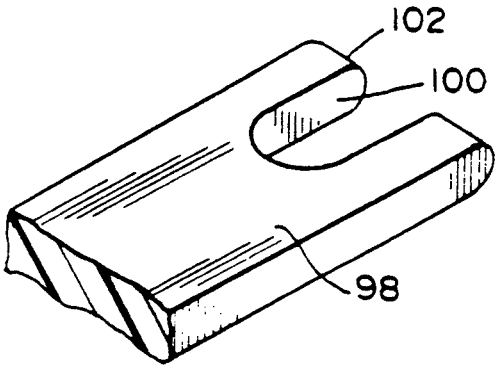
FIG. 5 is a perspective view of a tool for use in disengaging the latch arms of the embodiment of the invention shown in FIGS. 3 and 4.
Figure 3:
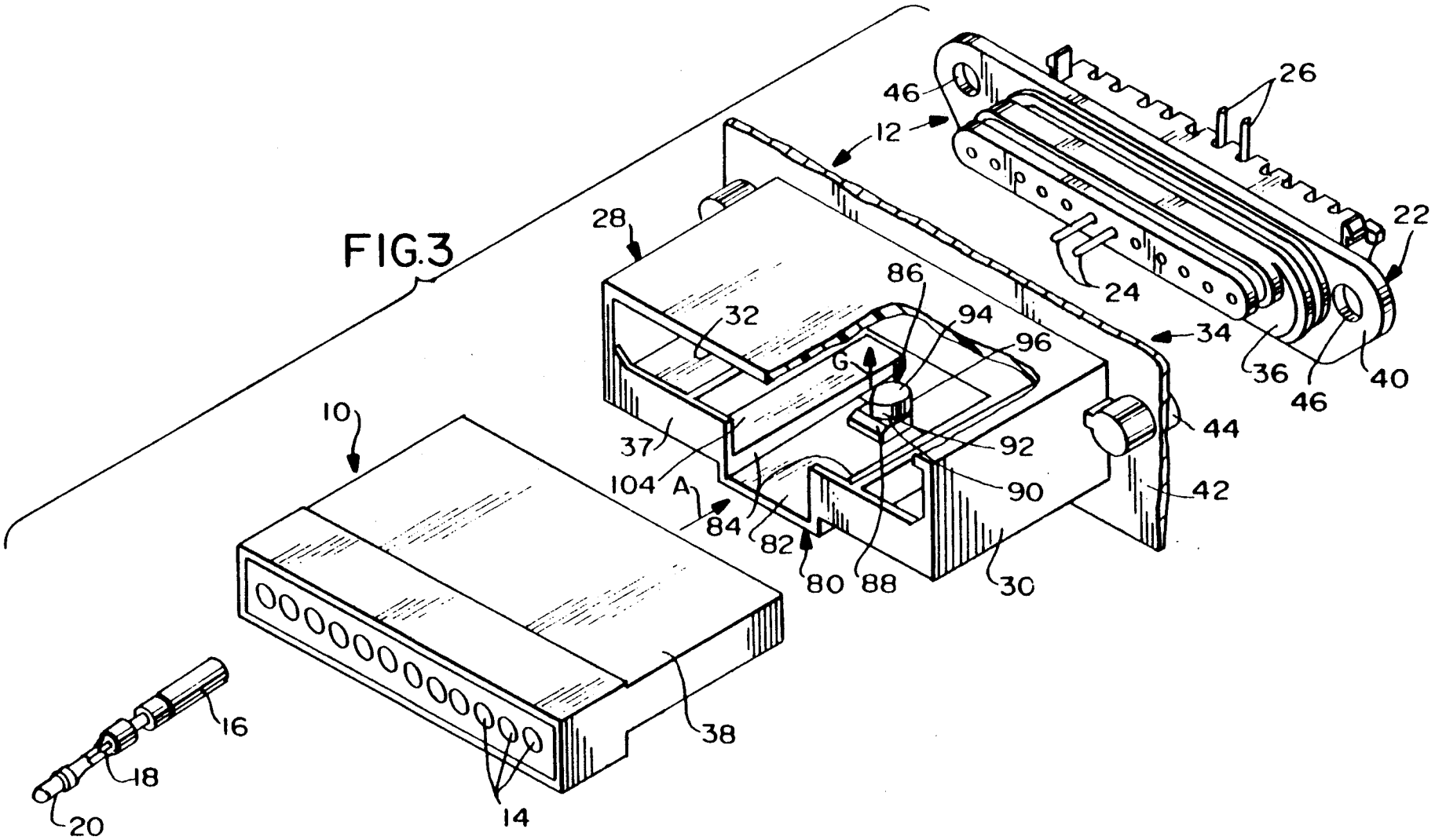
FIG. 3 is an exploded perspective view of another embodiment of an electrical connector assembly embodying the concepts of the invention.

Referring to the drawings in greater detail, FIGS. 1 and 2 illustrate one embodiment of the invention and FIGS. 3–5 illustrate a second embodiment of the invention, both embodiments being incorporated in similar connector components. Therefore, like numerals will be applied in all figures to designate like components.

Referring first to FIG. 1, the electrical connector assembly includes a first connector, generally designated 10, and a two-part second connector, generally designated 12. First connector 10 can be termed a receptacle connector in that it has a plurality of through passages 14 for receiving female terminals 16 (only one of which is shown in the drawings) which are crimped, as at 18, to electrical wires 20.

Second connector 12 includes a header, generally designated 22, which mounts a plurality of male terminal pins 24 projecting from one side of the header, with solder tail portions 26 of the pin terminals exposed on the opposite side of the header for soldering to a printed circuit board, for instance. Second connector 12 includes a second part, generally designated 28, which forms a hood or housing 30 defining an interior through cavity 32. Housing 30 and through cavity 32 define a terminating end 34 into which a plug portion 36 of header 22 is positioned and a mating end 37 into which a plug portion 38 of first connector 10 is positioned. When header 22 is assembled to housing 30, a peripheral flange 40 of header 22 engages a peripheral flange 42 on housing 30 and appropriate fastening means 44 are provided on flange 42 for insertion through fastening openings 46 in flange 40.

First and second connectors 10 and 12 are mated by moving plug portion 38 of connector 10 in the direction of arrow "A" and into cavity 32 of housing 30 at the mating end 36 thereof. When fully mated, latch means (described hereinafter) positively lock the connectors in their fully mated condition. When mated, hood or housing 30 covers or conceals the latch means.

At this point, it should be understood that the particular illustrated construction of first and second connectors 10 and 12 are but a preferred embodiment and variations in the construction of the connectors are contemplated. For instance, header 22 and housing 30 could be molded as a single unitary part for receiving and positioning male pin terminals 24. That is why the two-part connector is termed the second connector 12. Other obvious modifications in structure and configuration are contemplated by the invention.

Referring to FIG. 2 in conjunction with FIG. 1, first connector 10 is shown in FIG. 2 inverted in relation to the position of the connector shown in FIG. 1 in order to facilitate the illustration of the novel latch means of the invention. More particularly, a pair of latch arms 50 are integrally molded with plug portion 38 of the connector, as at 52, whereby the latch arms are deflectable about two angularly aligned axes of deflection. Specifically, both latch arms 50 are deflectable in the direction of double-headed arrow "B" about first respective axes "X". The latch arms also are deflectable in the direction of double-headed arrows "C" about a mutual second axis "Y". The distal ends of latch arms 50 are provided with outwardly projecting hook portions 54 defining leading cam surfaces 56.

Housing 30 of second connector 12 includes a hood portion 58 having side walls 60 between which latch arms 50 of first connector 10 are positionable when the connectors are mated. When mated, hood portion 58 covers latch arms 50. Cam ramps 62 (only one of which is visible in FIG. 1) project inwardly from side walls 60 for engagement by leading cam surfaces 56 of the latch arms. The bottom of hood portion 58 (as viewed in FIG. 1) includes a lever or lip 64 which has a distal end 64a, with the opposite end of the lever integrally molded to the housing, as at 66, to provide a living hinge or pivot whereby the lever is movable in the direction of double-headed arrow "D".

In operation of the latch means disclosed in the embodiment of FIGS. 1 and 2, plug portion 38 of first connector 10 is inserted into housing 30 of second connector 12, with the forward ends of latch arms 50 entering the hood portion 58, 60 of the housing. Before electrical contact is made between pin terminals 24 and female terminals 16, leading cam surfaces 56 of latch arms 50 engage cams 62. The latch arms are forced inwardly toward each other upon further mating movement of the connectors. When fully mated, trailing surfaces 66 on hook portions 54 of latch arms 50 snap behind abutment shoulders 68 on cams 62 to latch the connectors in fully mated condition. To this end, trailing surfaces 66 on the latch arms and abutment shoulders 68 on cams 62 are abrupt surfaces to provide a positive locking action between the mated connectors to prevent unmating.

In order to unmate the connectors shown in FIGS. 1 and 2, and to disengage the latch means, lever 64 (FIG. 1) is moved upwardly as viewed in the figure to engage the bottom surfaces of latch arms 50 (the top surfaces of the latch arms as viewed in FIG. 2). Continued movement of the lever causes the latch arms to deflect until they are sufficiently clear of cams 62 whereby first connector 10 can be withdrawn or unmated from first connector 12. It can be seen that, notwithstanding the fact that latch arms 50 are completely concealed within second connector 12, lever 64 effectively provides an accessing means from outside the connectors to deflect the latch arms and enable disengagement of the latch arms from cams 62 to facilitate unmating of the connectors.

Referring to FIGS. 3-5 and the second embodiment of the invention, as stated above, like reference numerals are applied to like components described above in relation to the connector assembly of FIGS. 1 and 2.

In the embodiment of the latch means of FIGS. 3-5, again a pair of latch arms 70 (FIG. 4) are integrally molded to first connector 10, as at 72. Again, the latch arms are deflectable about two angularly aligned axes of deflection so that the latch arms move in the direction of double-headed arrow "E" as well as double-headed arrow "F". Each latch arm 70 includes an inwardly directed hook 74 having a leading cam edge 76 and a trailing abrupt latching edge 78. Housing 30 of second connector 12 again includes a hood portion, generally designated 80, formed by a bottom wall 82 and opposite side walls 84. When mated, the hood portion covers and conceals the latch arms. A cam boss, generally designated 86, is molded integrally with and projects upwardly or inwardly from bottom wall 82. Cam 86 includes a lower, leading cam ramp 88, a plateau surface 90 and outwardly deflecting cam surfaces 92, along with a top surface 94. It also should be noted that bottom wall 82 of hood 80 is not "flat" or parallel to the bottom of housing 30. Instead, the bottom wall inclines upwardly (as viewed in the drawing) to define a larger opening at the mating end of the connector than the cross-sectional area of hood 80 in the vicinity of cam 86. This can be seen in FIG. 3 by the narrowing or tapering of side walls 84.

In operation of the embodiment of the invention shown in FIGS. 3 and 4, first connector 10 again is moved in the direction of arrow "A" and plug portion 38 of the connector is inserted into cavity 32 of housing 30. The distal or hooked ends of latch arms 70 (FIG. 4) enter hood 80. During further mating movement, the latch arms engage ramp surface 88 of cam 86 and are biased upwardly in alignment with outwardly deflecting cam surfaces 92 of the cam. Plateau surface 90 holds the latch arms upwardly during transitional movement from ramp surface 88 to cam surfaces 92. Leading cam surfaces 76 of the latch arms engage cam surfaces 92 of cam 86, and the latch arms are deflected outwardly in opposite directions in order to pass over the cam. If any unmating force is placed on the connector portions, the back side 96 of cam 86 will tend to deflect the arms 70 in an outward direction. This deflection is limited by walls 84 thereby preventing the latches 78 from extending beyond back side 96 of cam 86. Any further unmating force could damage latches 78. When fully mated, abrupt latching edges 78 of the latch arms positively latch behind cam 86 to hold the connectors in fully mated condition. To this end, it can be seen that a back side 96 of cam 86 is on a small radius in comparison to the angles of cam surfaces 92 to provide for latching of the connectors against unmating. The latch arms 70, the cam 86 and the distance between the sidewalls 84 are dimensioned to that complete outward deflection of the latch arms 70 will cause the top of the arms at their hook 74 to extend over surface 104. Such an extension over surface 104 will continue until latching edges 78 pass beyond cam 86.

In order to unmate the connectors shown in FIGS. 3 and 4, a deflecting tool 98 is provided for insertion into hood 80 beneath latch arms 70. The tool has cross-sectional dimensions slightly smaller than the larger opening at the mating end of the hood. The tool also has a notch 100 of a width to completely clear cam 86. When a forward end 102 of tool 98 is forced into hood 80, the tool rides up the inclined bottom wall 82 of the hood to force and deflect the latch arms upwardly in the direction of arrow "G" (FIG. 3) until the latch arms are clear of the top of cam 86. Once clear of the cam, the connectors easily can be unmated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for achieving positive latching in a fully mated condition, comprising:

a first connector including at least one latch arm resiliently deflectable about two angularly aligned axes of deflection;

a second connector including a cam disposed for engagement with said latch arm during mating of the connectors and for deflecting the latch arm about a first of said two axes of deflection into a latching condition in response to full mating of the connectors, the second connector including a housing for covering the latch arm inside the housing when the connectors are fully mated;

characterized in that the second connector includes a means for accessing the latch arm of the first connector from outside the housing of the second connector and to deflect the latch arm about a second of said two axes of deflection to enable disengagement of the latch arm from the cam for facilitating unmating of the connectors and wherein said means for accessing the latch arm and deflecting the latch arm about the second axis comprise deflecting means on the housing of the second connector and wherein said housing is a molded structure and said deflecting means is unitarily molded therewith 2. The electrical connector assembly of claim 1 wherein said deflecting means comprises a lever cantilevered on the housing and movable thereabout into engagement with the latch arm to move the latch arm out of engagement with the cam.

3. The electrical connector assembly of claim 1 wherein said means for accessing the latch arm and deflecting the latch arm about the second axis comprise a deflecting tool insertable through an access opening in the housing into engagement with the latch arm to move the latch arm out of engagement with the cam.

4. The electrical connector assembly of claim 3 wherein said housing has a mating end for receiving the first connector and a terminating end, said access opening being located in the mating end.

5. An electrical connector assembly for achieving positive latching in a fully mated condition, comprising:

a first connector including at least one latch arm resiliently deflectable about two angularly aligned axes of deflection;

a second connector including a cam disposed for engagement with said latch arm during mating of the connectors and for deflecting the latch arm about a first of said two axes of deflection into a latching condition in response to full mating of the connectors, the second connector including a housing having a terminating end and a mating end, the housing having an opening at the mating end for receiving the first connector and including a hood portion for enclosing the latch arm inside the housing when the connectors are fully mated;

characterized in that the second connector includes a deflecting means on the housing of the second connector in the area of said hood portion to deflect the latch arm about a second of said two axes of deflection and enable disengagement of the latch arm from the cam for facilitating unmating of the connectors and wherein said housing is a molded structure and said deflecting means is unitarily molded therewith.

6. The electrical connector assembly of claim 5 wherein said deflecting means comprises a lever cantilevered on the housing and movable thereabout into engagement with the latch arm to move the latch arm out of engagement with the cam.

* * * * *